US008539700B2

(12) United States Patent
Saba

(10) Patent No.: US 8,539,700 B2
(45) Date of Patent: Sep. 24, 2013

(54) IRON AND A METHOD THEREOF

(75) Inventor: Simon Saba, Withington (GB)

(73) Assignee: Russell Hobbs Limited, Manchester (GB)

( * ) Notice: Subject to any disclaimer, the term of this patent is extended or adjusted under 35 U.S.C. 154(b) by 104 days.

(21) Appl. No.: 13/270,736

(22) Filed: Oct. 11, 2011

(65) Prior Publication Data

US 2012/0090203 A1 Apr. 19, 2012

(30) Foreign Application Priority Data

Oct. 15, 2010 (GB) ..... 1017448.0

(51) Int. Cl.
*D06F 79/00* (2006.01)
*D06F 75/36* (2006.01)

(52) U.S. Cl.
USPC ..... 38/94; 38/141

(58) Field of Classification Search
USPC ..... 38/74–77.83, 88, 94, 141
See application file for complete search history.

(56) References Cited

U.S. PATENT DOCUMENTS

| | | | | |
|---|---|---|---|---|
| 2,786,287 | A * | 3/1957 | Swann | 38/77.4 |
| 2,802,288 | A * | 8/1957 | Hoecker | 38/77.5 |
| 4,233,763 | A * | 11/1980 | McMullen | 38/77.83 |
| 4,459,771 | A * | 7/1984 | Ogata | 38/77.8 |
| 6,243,976 | B1 * | 6/2001 | Beverly et al. | 38/77.5 |
| 7,040,046 | B2 * | 5/2006 | Renault et al. | 38/88 |
| 7,546,701 | B2 * | 6/2009 | Alipour | 38/79 |
| 7,552,552 | B1 | 6/2009 | Garman et al. | |

FOREIGN PATENT DOCUMENTS

| | | |
|---|---|---|
| DE | 81 15 797.5 U1 | 5/1981 |
| DE | 38 43 384 A1 | 7/1990 |
| EP | 2 025 804 A1 | 2/2009 |
| EP | 2 105 405 A1 | 9/2009 |
| GB | 890558 | 3/1962 |
| GB | 2 273 891 A1 | 7/1994 |
| WO | WO 98/29310 | 7/1998 |
| WO | WO 03/029552 A1 | 4/2003 |

OTHER PUBLICATIONS

British Search Report issued in British Application No. GB1017448.0 on Jan. 27, 2011.
European Search Report dated Feb. 7, 2012 issued in European Patent Application No. 11184810.7.

* cited by examiner

*Primary Examiner* — Ismael Izaguirre
(74) *Attorney, Agent, or Firm* — Oliff & Berridge, PLC

(57) ABSTRACT

An iron including a storage means to removably stow a funnel.

13 Claims, 3 Drawing Sheets

IRON AND A METHOD THEREOF

FIELD OF INVENTION

The present invention relates generally to steam irons. More specifically, the present invention concerns a means for preventing a funnel used to refill a steam iron from becoming lost and a method for preventing loss of the funnel.

BACKGROUND OF INVENTION

Steam irons have a reservoir within a body of the iron for storing water. The reservoir is refilled with water via an orifice positioned on the exterior of the body. When refilling the reservoir a separate funnel is often inserted into the orifice and used to channel water. However, such a funnel is bulky which presents a problem when storing the funnel. Furthermore, the funnel can be lost.

It is an objective of the present invention to overcome at least one of the above or other identified problems. More particularly, the objective is to provide a means for storing the funnel to prevent loss of the funnel.

SUMMARY OF THE INVENTION

According to the present invention there is provided an improved iron, and method as set forth in the appended claims. Other optional features of the invention will be apparent from the dependent claims and the description.

According to an aspect of the present invention there is provided an iron with a storage means to removably stow a funnel. Advantageously a funnel can be stowed with the iron to prevent the funnel from becoming lost.

Optionally the storage means includes a cavity positioned at a heel region of the iron to receive the funnel. Advantageously, the funnel when inserted into the cavity does not extend beyond a body of the iron. Consequently, the iron can be securely rested upon a suitably designed heel of the iron when the funnel is stowed. Furthermore, an iron can be adapted to include a cavity at the heel region without substantially changing the geometry or substantially increasing material usage. Furthermore, the funnel can be concealed within the cavity and is thereby prevented from being caught on anything else when being placed in or removed from storage.

The storage means and funnel may be secured using a first securing means. Advantageously, the funnel can be secured to the storage means using the first securing means, thereby preventing the funnel from separating from the storage means accidentally such that loss of the funnel could occur.

In one example the first securing means includes a bayonet fitting. The bayonet fitting comprises one or more outwardly extending latches positioned on the funnel suitable for engaging one or more catches positioned on the storage means. In another example the first securing means comprises a screw fitting. The screw fitting including a male thread positioned on the funnel suitable for engaging with a female thread positioned on the first securing means. In another example the first securing means comprises a clip fitting, the clip fitting including one or more elastic clips positioned in the funnel suitable for engaging a catch positioned on the storage means. In another example the first securing means comprises opposed surfaces positioned on the funnel and first securing means such that the funnel is mated to the storage means using friction. Advantageously, the above fittings can be quickly disengaged and engaged.

Optionally, the funnel includes a finger grip positioned in a mouth region of the funnel. The finger grip is arranged to be gripped by a user to manipulate the position on the funnel. Advantageously, the finger grip can be gripped by the user to remove the funnel from the storage means and disengage the first securing means.

Optionally, the funnel includes one or more breather holes. The one or more breather holes comprise a passageway through a stem region of the funnel. Advantageously, the breather holes enable air outflow through a passage way separate to water inflow when refilling a reservoir within the iron.

An orifice for filling the iron with water and the funnel may be secured using a second securing means. Advantageously, the funnel may be secured to the orifice when filling the iron.

Optionally, the second securing means comprises the same fitting as the first securing means. Advantageously, the funnel can be secured to the storage means or to the orifice by using the same operation.

According to a further aspect of the present invention there is provided a method of storage for an iron and a funnel. The method comprising removably stowing the funnel on a storage means positioned on the iron.

Optionally the method includes securing the funnel to the storage means using a first securing means.

Optionally the method includes securing the funnel to an orifice positioned on the iron by engaging a second securing means.

According to a further aspect of the present invention there is provided a kit of parts comprising a funnel and an iron. The iron including a storage means to removably stow a funnel.

According to a further aspect of the present invention there is provided a method of refilling an iron. The method comprising removing a funnel from a storage means positioned on the iron. The removal of the funnel from the storage means including a step of disengaging a first securing means. Securing the funnel to an orifice positioned on the iron by engaging a second securing means. Filling the iron through the orifice via the funnel. Disengaging the funnel from the second securing means. Attaching the funnel to the storage means. The attaching of the funnel to the storage means including a step of engaging the first securing means.

BRIEF DESCRIPTION OF THE DRAWINGS

For a better understanding of the invention, and to show how embodiments of the same may be carried into effect, reference will now be made, by way of example, to the accompanying diagrammatic drawings in which.

DETAILED DESCRIPTION OF THE EXEMPLARY EMBODIMENTS

Figure 1:
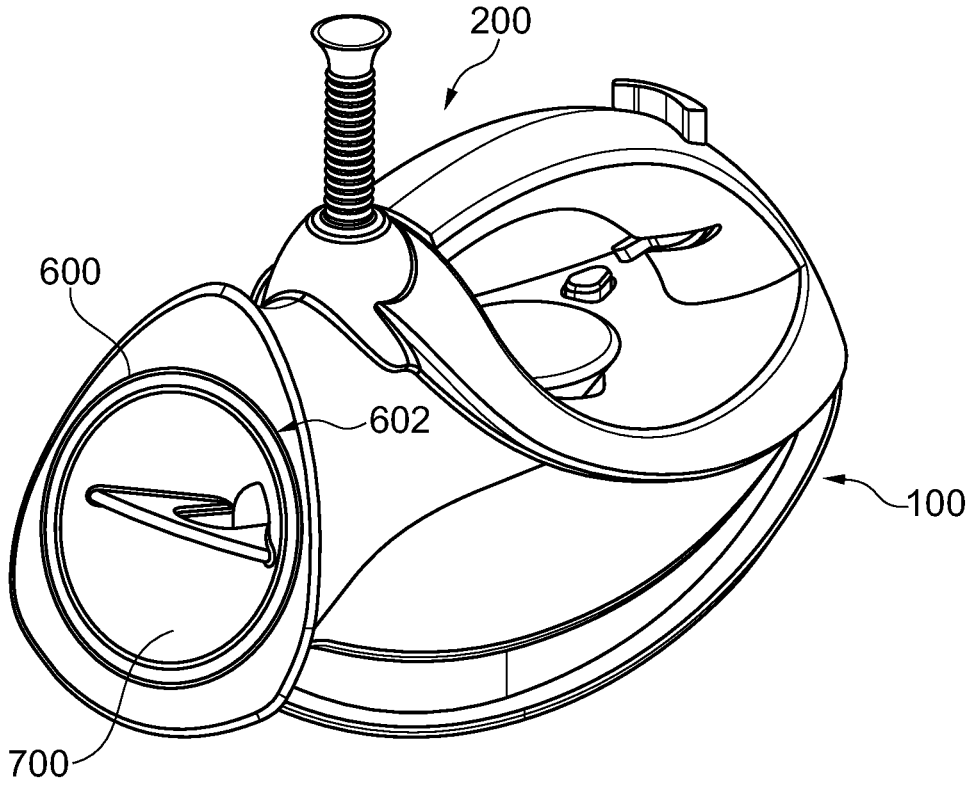
FIG. 1 is an isometric view showing an iron including a funnel according to the present invention.

FIG. 1 is an isometric view of an iron 100. The body 200 of the iron 100 includes a storage means 600 to removably stow a funnel 700. Advantageously, the funnel 700 can be stowed with the iron 100 to prevent the funnel 700 from becoming lost.

The storage means 600 comprises any means suitable for removably attaching the funnel 700 to the body 200 of the iron 100. In this example the storage means includes a cavity 602 that the funnel 700 can be stowed within. However, in another example the funnel need not be stowed within a cavity.

Figure 2:
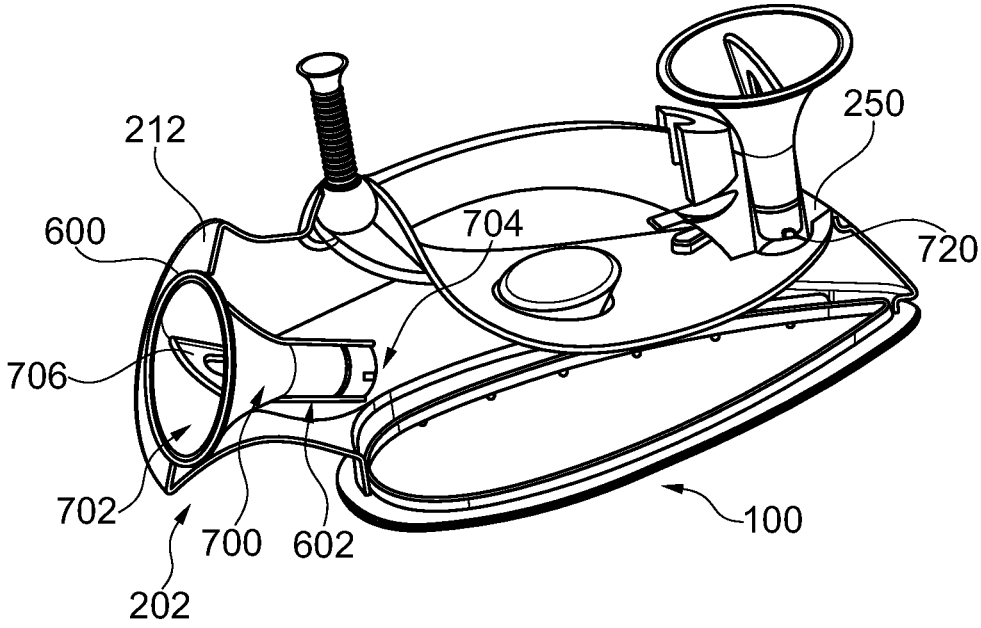
FIG. 2 is a cut-away isometric view showing the iron and funnel according to the present invention.

FIG. 2 is an isometric view showing the storage means 600 and funnel 700 in more detail. In this example the storage means 600 is positioned in the heel region 202 of the body 200 of the iron 100. In another example the storage means 600 may be positioned elsewhere on the body 200 of the iron 100.

Advantageously, in this example, the funnel 700 when stowed sits level to, or is concealed within, the cavity 602. In this way the funnel 700 or heel 212 of the iron 100 may provide a surface to rest the iron 100 upon. Advantageously, by positioning the cavity 602 in the in the heel region 202 of the iron 100 the funnel 700 can be stowed compactly without substantially changing the geometry of the iron. Consequently, the storage means 600 can be incorporated in an iron without a substantial increase in material usage.

The funnel 700 comprises a means for channelling water through a mouth region 702 into a stem region 704. The mouth region 702 has a large cross-sectional area and the stem region 704 has a reduced cross-sectional area. The funnel includes a finger grip 706. The finger grip comprises a substantially flat surface positioned within the mouth region 704, that can be gripped by a user to manipulate the position on the funnel 700. Advantageously, the finger grip 706 can be gripped by the user to remove the funnel 700 from the storage means 600. The funnel 700 further includes one or more breather holes 750 (not shown). The breather holes 750 comprise separate passageways through the funnel 700. Advantageously, the breather holes 750 enable air outflow through a passage way separate to water inflow when refilling a reservoir within the iron 100. The geometry of the mouth region 702 and stem region 704 of the funnel 600 may encompass a wide-range of variations known in the art all of which are capable of being stowed by the storage means 600.

Figure 3:
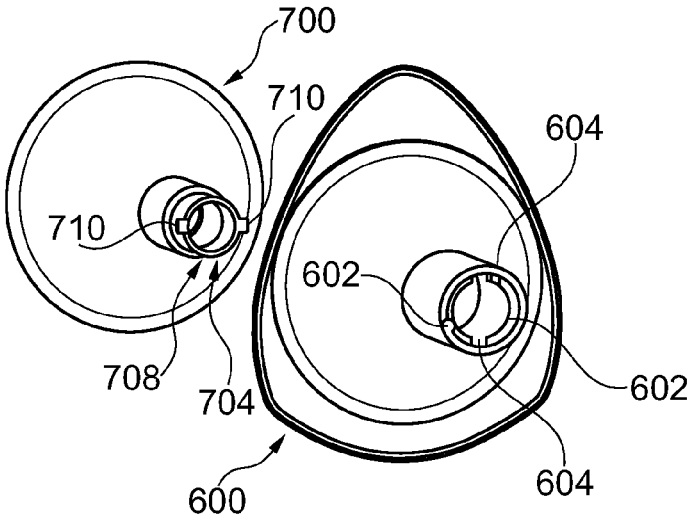
FIG. 3 is an enlarged isometric view of the funnel shown in FIG. 1.

FIG. 3 shows the funnel 700 in more detail. Here the funnel 700 is attached to the storage means 600 by a securing means 708. The securing means 708 comprises any means to securely attach the funnel 700 to the storage means 600. In this example the securing means 708 comprises a bayonet fitting, which includes one or more outwardly extending latches 710 positioned on the stem region 704 of the funnel 700. The storage means 600 includes one or more catches 602 for receiving the latches 710. In use the stem 704 of the funnel 700 is inserted into the storage means 600 such that the latches 710 pass through gaps 604 in the catches 602. Thereafter, the funnel 700 is rotated such that the latches 710 are engaged with the catches 604. Advantageously, the funnel can be secured to the body 200 of the iron 100 using the securing means 708, thereby preventing the funnel 700 from separating from the iron. To remove the funnel 700 from the securing means 708, the funnel 700 is rotated to disengage the latches 710 from the catches 602. Thereafter, the funnel can be removed by retracting the latches 710 through the gaps 604. Advantageously, the funnel 700 can be manipulated during the above operations using the finger grip 706.

Figure 4:
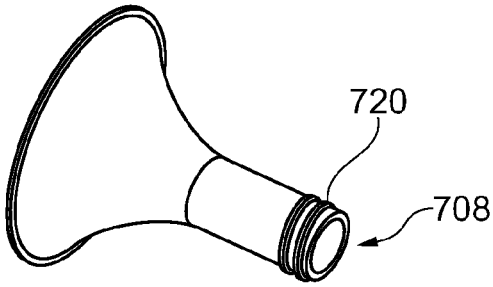
FIGS. 4 and 5 are enlarged isometric views of additional embodiments of a funnel according to the present invention.

FIG. 4 shows an alternative securing means 708 in more detail. In this example the securing means 708 comprises a screw fitting. Here the funnel 700 is secured to the storage means 600 by engaging a male thread 720 on the funnel 700 with a female thread on the storage means 600.

Figure 5:
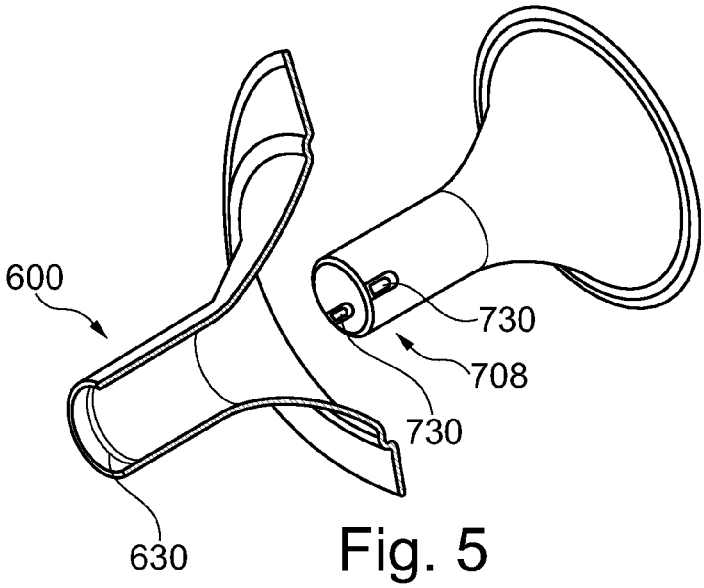

FIG. 5 shows an alternative securing means 708 in more detail. In this example the securing means 708 comprises a clip fitting. Here the funnel 700 is secured to the storage means 600 by engaging one or more outwardly extending protrusions 730 on the funnel 700 with a recess 630 on the storage means 600. The protrusions 730 may be elastically supported or made from an elastic material to facilitate their insertion into the recess.

The securing means 708 may further include a tight fitting stem 704 and storage means 600, such that the funnel 700 is held in place by friction.

Referring back to FIG. 2, the body 200 of the iron further includes and orifice 250. The orifice 250 comprises an inlet with a small cross-sectional area for filling the iron 100 with water. Optionally, the orifice 250 includes a second securing means 720 for securing the funnel 700. The second securing means 720 comprises any means to securely attach the funnel 700 to the orifice 250. Advantageously, the funnel 700 may be secured to the orifice 250 when filling the iron. Here the securing means 708 and second securing means 720 comprise the same fitting. Consequently, the funnel can be secured to the storage manes 600 orifice 250 by using the same operation.

To fill the iron 100 the funnel 700 is removed from the storage means 600 by disengaging the securing means 708. Thereafter, the funnel 700 is secured to the orifice 250 by engaging the second securing means 720 and the iron 100 can be filled. After filling the iron 100, the funnel 700 is disengaged from the second securing means 720. The funnel 700 is then secured to the storage means 600 by engaging the securing means 708.

Figure 6:
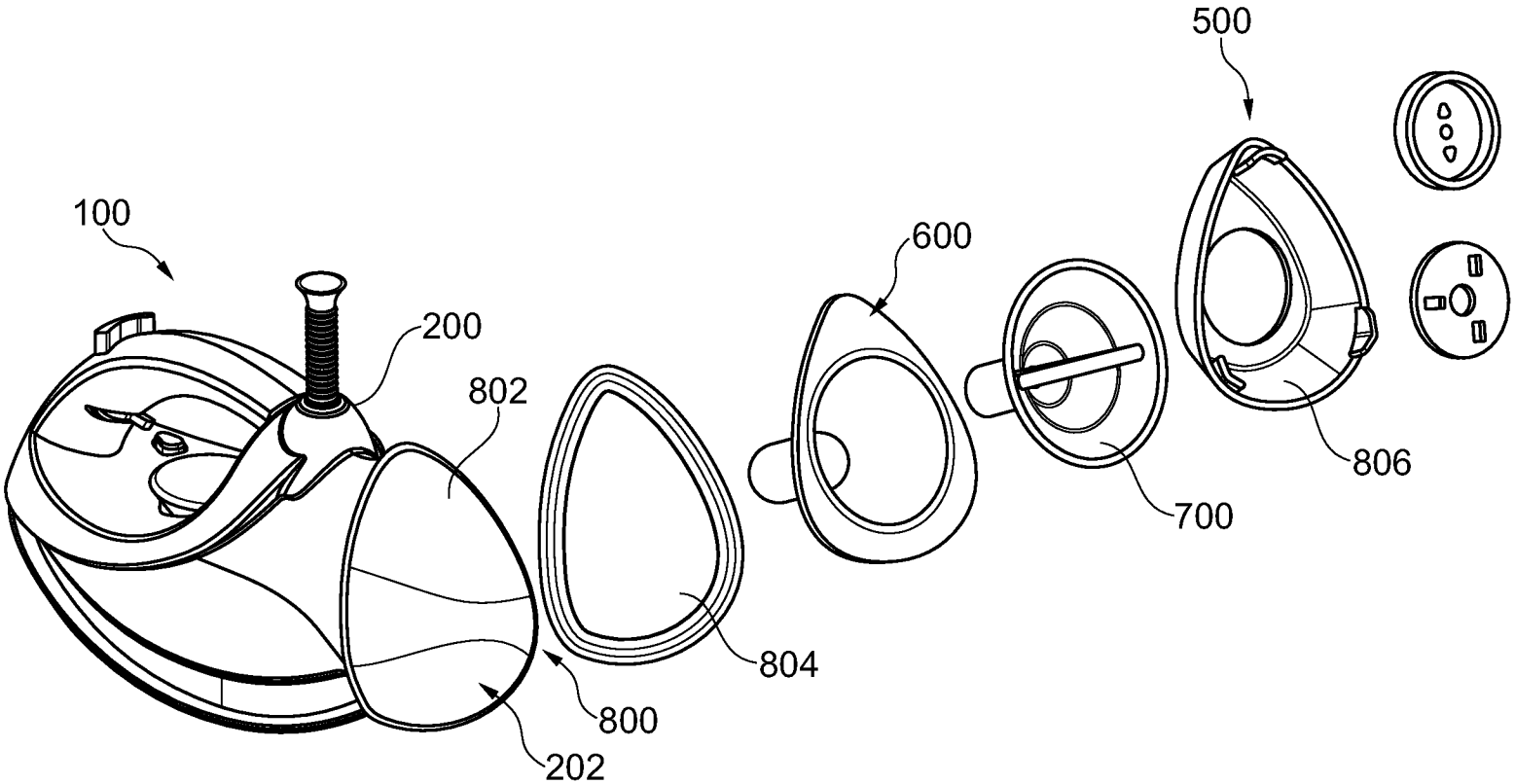
FIG. 6 is an exploded isometric view showing a modular attachment for an iron according to the present invention.

FIG. 6 shows a modular fitting 800 for an iron 100. In this example the modular fitting 800 is positioned in the heel region 202 of the body 200 of the iron 100. However, the modular fitting 800 can be positioned elsewhere on the body 200 of the iron 100. The modular fitting comprises a container 802 that enables a range of configurations for the iron 100. In one example the container 802 may be configured to be sealed with a blanking plate 804. In a further example the container 802 may be configured to comprise a storage means 600 to removably stow a funnel 700. In a yet further example the container 802 may be configured to comprise a receiving means 500 and support plate 806 for storing a connector 300 and cable 400.

Although preferred embodiments(s) of the present invention have been shown and described, it will be appreciated by those skilled in the art that changes may be made without departing from the scope of the invention as defined in the claims.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. An iron comprising:

a heel region and a front;

a funnel;

storage means to removably stow the funnel, the storage means including a cavity suitable for receiving the funnel at the heel region and a filling orifice at the front for filling the iron using the funnel.

2. The iron as claimed in claim 1, wherein the storage means and funnel are securable using a first securing means.

3. The iron as claimed in claim 2 wherein, the first securing means comprises a bayonet fitting.

4. The iron as claimed in claim 2, wherein the first securing means comprises a screw fitting.

5. The iron as claimed in claim 2, wherein the first securing means comprises a clip fitting.

6. The iron as claimed in claim 2, wherein the first securing means comprises a friction fitting, the friction fitting including:

opposed surfaces positioned on the storage means and funnel.

7. The iron as claimed in claim 1, wherein the funnel includes a finger grip positioned on a mouth region of the funnel.

8. The iron as claimed in claim 1, wherein the iron includes an orifice for filling the iron with water, wherein the orifice and funnel may be secured using a second securing means.

9. A method of using the iron according to claim 1, the method comprising removably stowing a funnel on a storage means positioned on the iron.

10. The method as clamed in claim 9, including a step of securing the funnel to the storage means by engaging a first securing means.

11. The method as claimed in claim 9, including a step of securing the funnel to an orifice positioned on the iron by engaging a second securing means.

12. The method as claimed in claim 9 in which the iron includes a storage means to removably stow a funnel.

13. A kit of parts comprising:

an iron defining a heel region and a front;

a funnel; and storage means to removably stow the funnel, the storage means including a cavity suitable for receiving the funnel at the heel region and a filling orifice at the front for filling the iron using the funnel.

* * * * *